United States Patent [19]

Chiang

[11] Patent Number: 4,713,586

[45] Date of Patent: Dec. 15, 1987

[54] DECORATIVE LIGHT SETS

[75] Inventor: Chun C. Chiang, Hsinchu, Taiwan

[73] Assignee: Dar Yu Electronic Co., Ltd., Hsinchu, Taiwan

[21] Appl. No.: 888,926

[22] Filed: Jul. 22, 1986

[51] Int. Cl.[4] ..... H05B 37/00

[52] U.S. Cl. ..... 315/200 A; 307/157; 315/185 S; 315/186; 315/323; 315/360; 362/806; 362/811

[58] Field of Search ..... 315/200 A, 323, 360, 315/185 S, 186; 307/157, 40; 362/183, 184, 806, 800; 340/81 R

[56] References Cited

U.S. PATENT DOCUMENTS

| | | | |
|---|---|---|---|
| 3,493,813 | 2/1970 | Seidler | 315/200 A |
| 3,916,253 | 10/1975 | Driscoll | 315/323 |
| 4,264,845 | 4/1981 | Bednarz | 362/806 |

OTHER PUBLICATIONS

"Cycling Flashing Light" by Dr. T. F. North, Electronic Engineering, Mar. 1981, p. 33.

*Primary Examiner*—Harold Dixon

*Attorney, Agent, or Firm*—Michael N. Meller

[57] ABSTRACT

The present invention is an improved decorative light set with clusters of light bulbs, an electric circuit and a d.c. power source for actuating the bulbs of clusters of the light bulbs and the electric circuit, wherein the circuit has two oscillators for producing pulses, a comparator for comparing the pulses of the two oscillators, a decoder actuated by the comparator. Random output signals are output by the decoding means for lighting the bulbs randomly as if the light set is sparkling and twinkling without using a long extending wire from a power source.

3 Claims, 1 Drawing Figure

DECORATIVE LIGHT SETS

BACKGROUND OF THE INVENTION

The present invention relates to improvements in decorative light sets of the type especially designed for the lighting and ornamentation of Christmas trees and use as festive decoration, and more particularly of the type for outdoor decoration which uses an electric circuit with a d.c. power source and decoding means to light up clusters of light bulbs randomly, and which conveniently does not need a long extension cord from the power source.

In recent years, it has become increasingly popular for individuals and businesses to use a series of small-size decorative bulbs for ornamenting and beautifying their surroundings day after day.

Many decorative light sets are in an arrangement whereby a plurality of bulbs are connected together in series or parallel connection along a long wire and the light sets are adapted to connect with an a.c. power source. This arrangement has the disadvantages that short circuits can easily occur, as can current leakage, which is dangerous for anyone who touches the set. Also, a long wire is usually needed to extend from the a.c. power source if the light sets are used for outdoor decoration.

SUMMARY OF THE INVENTION

With the above problems in mind, the main object of the invention is to provide an improved decorative light set with a d.c. power source which has simple electric circuitry and is convenient to use outdoors.

An object of the invention is to provide an improved decorative light set, the bulbs of which are in parallel connection and controlled by a decoding means for actuating the bulbs randomly and lighting the bulbs by random pulses so that the lights twinkle.

Another object of the invention is to provide an improved decorative light set arranged with an electric circuit using a d.c. power source so that there is no need to prepare a long extension cord when the set is used outdoors.

A further object of the invention is to provide an improved decorative light set which is simple in construction and cheap to produce.

In order to achieve the aforesaid objects as well as other incidental objects and advantages, the invention provides an electric circuit having a decoding means, outputs of which connect with a plurality of transistors, a comparing means, the output of which connects to the input of decoding means for actuating the decoding means by its output signal, an oscillating means, the output of which connects with the input of the comparing means for actuating the comparing means, and a d.c. power source supplying power to the electric circuit so that a plurality of random output signals can be produced from the output of the decoding means.

Many clusters of bulbs, the bulbs of each cluster being in parallel connection, are connected with the decoding means through the transistors, wherein the bulbs are lit randomly as the random output pulses of the decoding means actuate the bases of the transistors so that the light set twinkles brightly.

BRIEF DESCRIPTION OF THE DRAWING

These and other advantages, objects and features of the present invention will become apparent from the following detailed description of the preferred embodiment with reference to the accompanying drawing, wherein.

DETAILED DESCRIPTION OF THE PREFERRED EMBODIMENT

Figure 1:
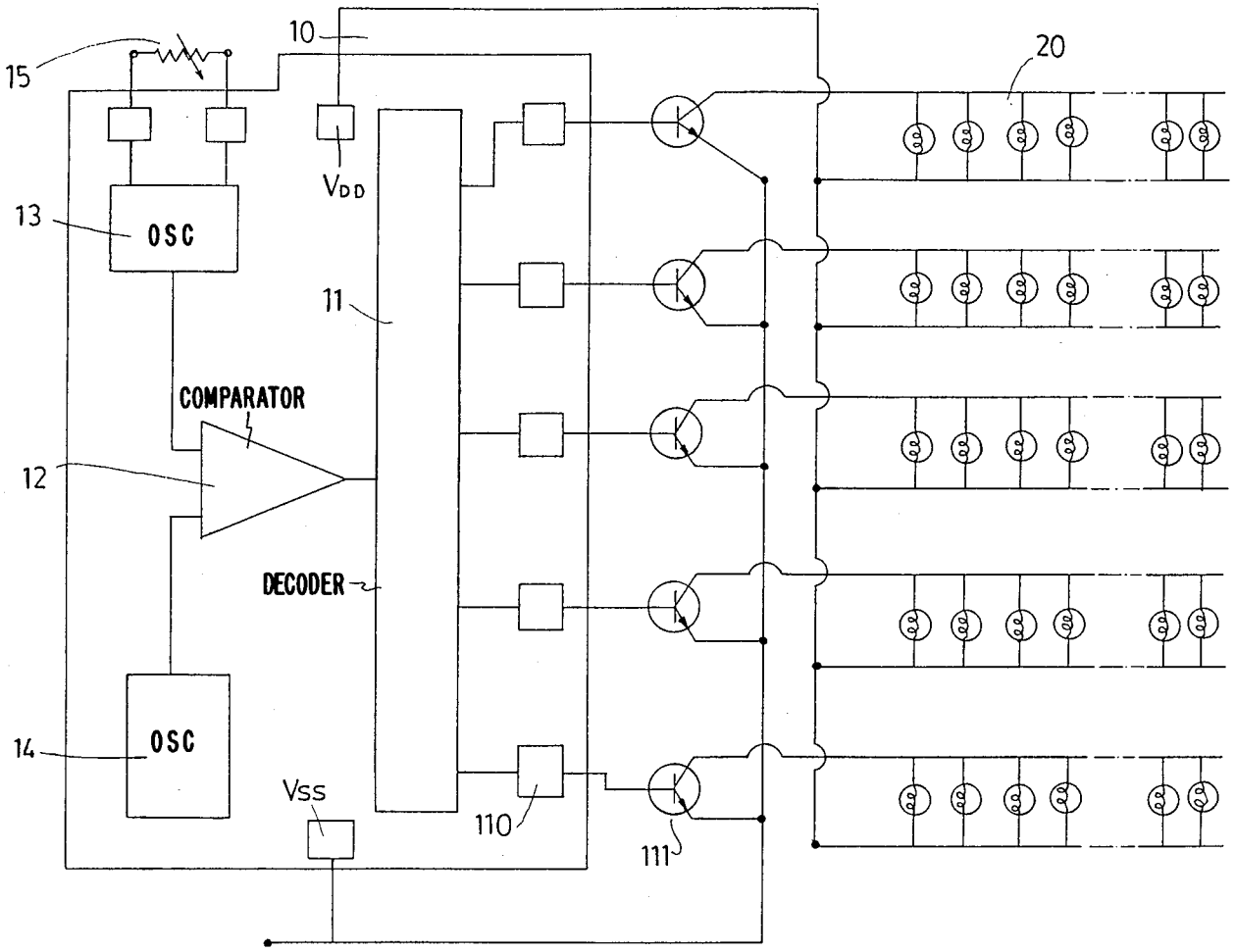
FIG. 1 is a schematic view of the preferred embodiment of the invention.

The following is a detailed description of the best presently contemplated embodiment of the invention. This description is not to be taken in a limiting sense, but is made merely for the purpose of illustrating the general principles of the invention.

Referring to FIG. 1, the present invention includes an electric circuit 10 adapted to connect to a d.c. power source having a decoding means 11, the outputs of which are connected with a plurality of transistors 111, and a comparing means 12, the output of which is connected with the input of the decoding means 12. Two oscillating means 13 and 14, having different output pulses with different time intervals, are connected to the inputs of the comparing means 12. The d.c. power sources $V_{DD}$ and Vss supply power to the electric circuit 10 and a plurality of triggers 110 are respectively connected a plurality of outputs of the decoding means 11, so that random output signals are produced from the outputs of the decoding means 11.

Clusters of light bulbs 20, the bulbs of each cluster 20 being in parallel connection, are connected with the transistors 111, wherein the bulbs light up randomly in response to the random output signals of the decoding means 11 passing through the triggers 110, which actuate the transistors 111 so that the light set can twinkle randomly, which is attractive and amusing.

As the decorative light set is designed with a d.c. power source and a simple electric circuit, it is not necessary to use a long wire from an a.c. power source, as needed in the prior art, if the set is used for outdoor decoration.

One of the oscillating means 13 can be controlled by a variable resistor 15 for varying the output signals of the decoding means 11 so that the blinking time interval of the bulbs can be controlled and the decorative light set can be more attractive and amusing.

While the invention has been described with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. An improved decorative light set comprising:

(a) a plurality of sets of light bulbs, the light bulbs in each set being connected in parallel across first and second terminals;

(b) a first d.c. voltage source, said first terminals being connected in series to said first d.c. voltage source;

(c) a plurality of transistors respectively connected to said plurality of second terminals, a plurality of third terminals, and a plurality of fourth terminals;

(d) a second d.c. voltage source, said third terminals being connected in series to said second d.c. voltage source;

(e) a plurality of trigger means, each trigger means having an input terminal and an output terminal, the output terminal of each trigger means being connected to a corresponding fourth terminal;

(f) decoding means having a plurality of output terminals respectively connected to said input terminals of said plurality of trigger means;

(g) a comparing means having an output terminal connected to an input terminal of said decoding means;

(h) a first oscillating means having an output terminal connected to a first input terminal of said comparing means; and a second oscillating means having an output terminal connected to a second input terminal of said comparing means, wherein said decoding means outputs signals for switching said transistors on in dependence on the output signals received from said comparing means, said switching on of said transistors controlling the activation of said corresponding sets of light bulbs.

2. The improved decorative light set as defined in claim 1, further comprising a variable resistor coupled to said first oscillating means for controlling the frequency of the signal output by said first oscillating means.

3. The improved decorative light set as defined in claim 1, wherein said first oscillating means outputs a signal having a first predetermined frequency and said second oscillating means outputs a signal having a second predetermined frequency different than said first predetermined frequency.

* * * * *